United States Patent [19]

Lommers

[11] Patent Number: 4,782,280

[45] Date of Patent: Nov. 1, 1988

[54] TRANSISTOR CIRCUIT WITH E/C VOLTAGE LIMITER

[75] Inventor: Anthonius J. J. C. Lommers, Eindhoven, Netherlands

[73] Assignee: U.S. Philips Corporation, New York, N.Y.

[21] Appl. No.: 62,918

[22] Filed: Jun. 16, 1987

[30] Foreign Application Priority Data

Jul. 2, 1986 [NL] Netherlands ..... 8601718

[51] Int. Cl.[4] ..... G05F 1/56

[52] U.S. Cl. ..... 323/276; 323/278; 323/289; 363/50; 363/89

[58] Field of Search ..... 323/270–278, 323/281, 289, 303; 363/89, 50

[56] References Cited

U.S. PATENT DOCUMENTS

| | | | |
|---|---|---|---|
| 3,078,410 | 2/1963 | Thomas | 323/278 |
| 3,113,260 | 12/1963 | Wiley | 323/278 |
| 3,182,246 | 5/1965 | Lloyd | 323/276 |
| 3,445,751 | 5/1969 | Easter | 323/278 |
| 3,711,763 | 1/1973 | Peterson | 323/276 |
| 3,771,021 | 11/1973 | Bierly | 323/277 X |
| 3,939,399 | 2/1976 | Funatsu et al. | 323/275 |
| 4,254,372 | 3/1981 | Moore, Jr. | 323/277 |
| 4,390,828 | 6/1983 | Converse et al. | 323/278 X |

FOREIGN PATENT DOCUMENTS

| | | | |
|---|---|---|---|
| 1188719 | 5/1984 | U.S.S.R. | 323/275 |

*Primary Examiner*—Patrick R. Salce
*Assistant Examiner*—Emanuel Todd Voeltz
*Attorney, Agent, or Firm*—Thomas A. Briody; David R. Treacy; Bernard Franzblau

[57] ABSTRACT

In a series-regulation transistor ($T_1$), which is driven by a drive circuit (10), for generating a constant voltage across a load ($R_L$) the occurrence of comparatively large substrate currents in the case of saturation of the series-regulation transistor ($T_1$) is precluded by a limiting circuit comprising a resistor ($R_1$) arranged in the base line of the series-regulation transistor ($T_1$) and a second transistor ($T_2$) whose base-emitter junction is arranged across the resistor ($R_1$) and the base-collector junction of the series-regulation transistor ($T_1$). The collector of the second transistor is connected to a control input (12) of the drive circuit.

14 Claims, 2 Drawing Sheets

TRANSISTOR CIRCUIT WITH E/C VOLTAGE LIMITER

Figure 1:
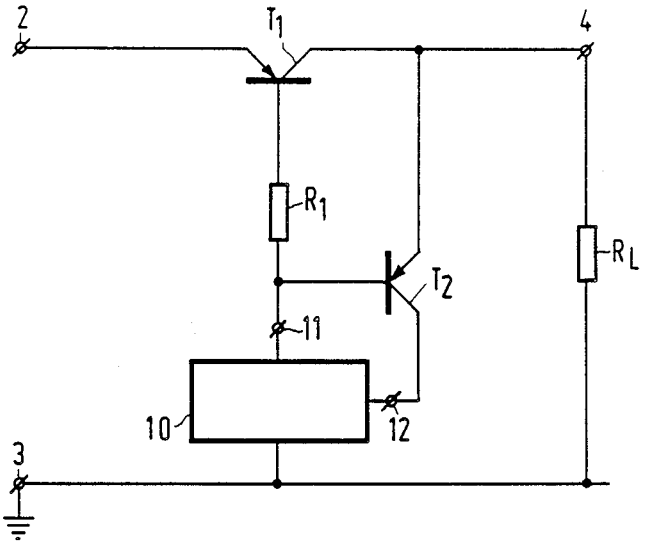

This invention relates to a circuit arrangement comprising:

a first transistor of a first conductivity type having an emitter coupled to a first power-supply terminal, a collector coupled to an output terminal, and a base, a drive circuit for driving the first transistor, which drive circuit is coupled to a second power supply terminal and has an output coupled to the base of the first transistor, and a limiting circuit for limiting the voltage between the emitter and the collector of the first transistor to a specific value by reducing the drive to the first transistor when said voltage decreases below said value.

Such a circuit arrangement may be employed in, for example, series-regulated voltage-stabilising arrangements.

Such a circuit arrangement is disclosed in U.S. Pat. No. 3,939,399. When the input voltage decreases the first transistor is driven into saturation at a given instant. In the case of strong saturation of this transistor large substrate currents occur below a specific collector-emitter voltage because the substrate diode is turned on. If the input voltage is supplied by a battery, these substrate currents cause the battery to be discharged at a faster rate, which is undesirable. In order to prevent the occurrence of these substrate currents, the collector-emitter voltage of the first transistor should not decrease below a specific minimum value. For this purpose the known circuit arrangement comprises a limiting circuit. This limiting circuit comprises a series arrangement of a resistor and the base-emitter junction of a transistor whose collector is connected to the drive circuit of the first transistor, which series arrangement is connected across the emitter-collector path of the first transistor. A current source feeds a constant current through the resistor so as to produce a constant voltage across this resistor. Below a specific collector-emitter voltage the transistor is driven into conduction, which reduces the drive to the first transistor and thus causes the collector-emitter voltage of the first transistor to increase.

However, this known circuit arrangement has the disadvantage that as a result of the spread in the values of the resistor, the current source and the transistor parameter, the value of the collector-emitter voltage of the first transistor, for which the limiting circuit is activated, should be selected to be on the safe side in order to prevent the occurrence of substrate currents. In the case of a battery supply this has the disadvantage that the batteries are not discharged to the maximum extent and therefore have to be replaced prematurely. Therefore, it is an object of the invention to provide a limiting circuit for such a circuit arrangement which prevents the occurrence of substrate currents in a manner which is substantially independent of the spread in the components required for this circuit. According to the invention a circuit arrangement of the type defined in the opening paragraph is characterized in that the limiting circuit comprises a first resistor arranged between the output of the drive circuit and the base of the first transistor, and a second transistor of the first conductivity type having an emitter coupled to the collector of the first transistor, a collector coupled to a control input of the drive circuit, and a base coupled to that end of the first resistor which is situated nearest the drive circuit. In the circuit arrangement in accordance with the invention the second transistor is driven into conduction at the instant at which the difference between the voltage produced across the first resistor by the base current of the first transistor plus the base-emitter voltage of the first transistor and the emitter-collector voltage of the first transistor exceeds the base-emitter threshold voltage of the second transistor. For a given value of the first resistor the activation of the limiting circuit depends on the decrease of the collector-emitter voltage and the increase of the base current of the first transistor, i.e. entirely on the first transistor regardless of tolerances in this transistor.

A first embodiment of the invention is characterized in that the drive circuit comprises a third transistor of a second conductivity type having an emitter coupled to the second power-supply terminal by means of a second resistor, a collector coupled to the output of the drive circuit, and a base coupled to a circuit for supplying a control voltage to the third transistor, and in that the control input of the drive circuit is constituted by the emitter of the third transistor.

A second embodiment of the invention is characterized in that the drive circuit comprises a third transistor of the first conductivity type having an emitter coupled to the output of the drive circuit, a collector coupled to the second power-supply terminal, and a base coupled to a circuit for supplying a control current to the third transistor, and that the control input of the drive circuit is constituted by the base of the third transistor. This embodiment may be characterized further in that the circuit for supplying a control current to the third transistor comprises a constant-current source for supplying a first current and a detection circuit for supplying a second current which is proportional to the difference in the voltage between the output terminal and the second powersupply terminal and a reference voltage, and in that the control current is formed by the difference between the first current and the second current.

If it is required that the circuit arrangement be rendered inoperative, this can be achieved by means of a further embodiment which is characterized in that the constant -current source comprises a fourth transistor of the first conductivity type having an emitter connected to the first power-supply terminal, a collector connected to the second power-supply terminal by a second resistor, and a base coupled to its collector, and in that the circuit arrangement further comprises a fifth transistor of the first conductivity type having an emitter coupled to the emitter of the fourth transistor, a collector connected to the collector of the fourth transistor, and a base, and a sixth transistor of the second conductivity type having a collector connected to the base of the fifth transistor via a third resistor, an emitter connected to the second power-supply terminal via a fourth resistor, and a base connected to a switching input for applying a switching voltage, and a seventh transistor of the first conductivity type having an emitter connected to the collector of the fifth transistor, a collector connected to the emitter of the sixth transistor, and a base connected to that end of the third resistor which is connected to the collector of the sixth transistor.

Figure 2:
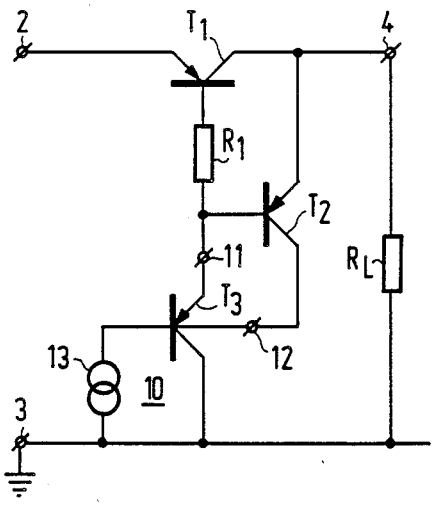
Figure 3:
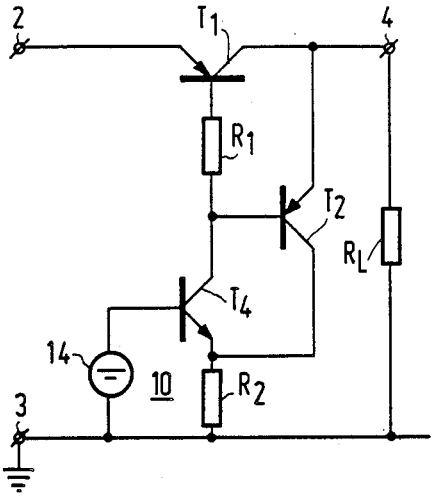
Figure 4:
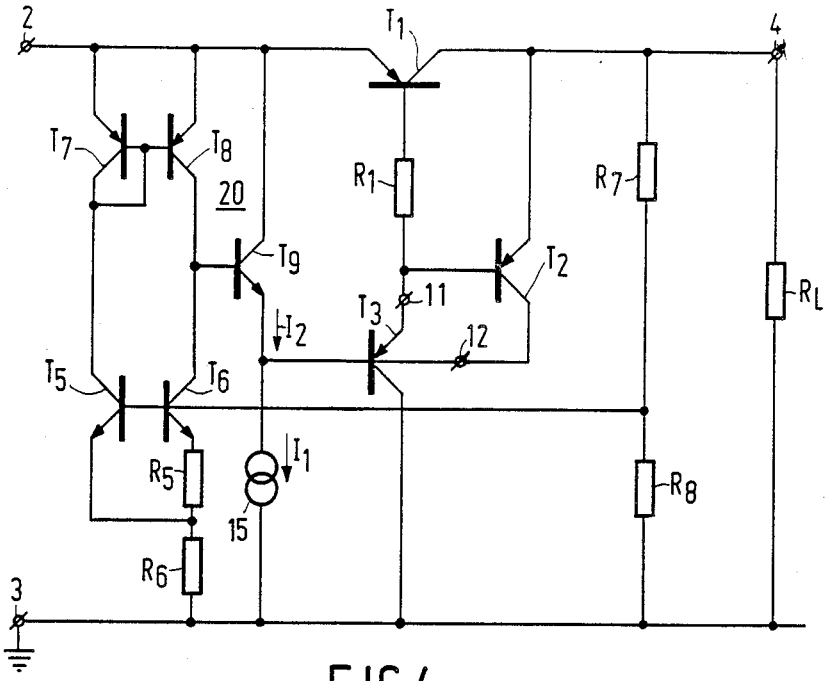
Figure 5:
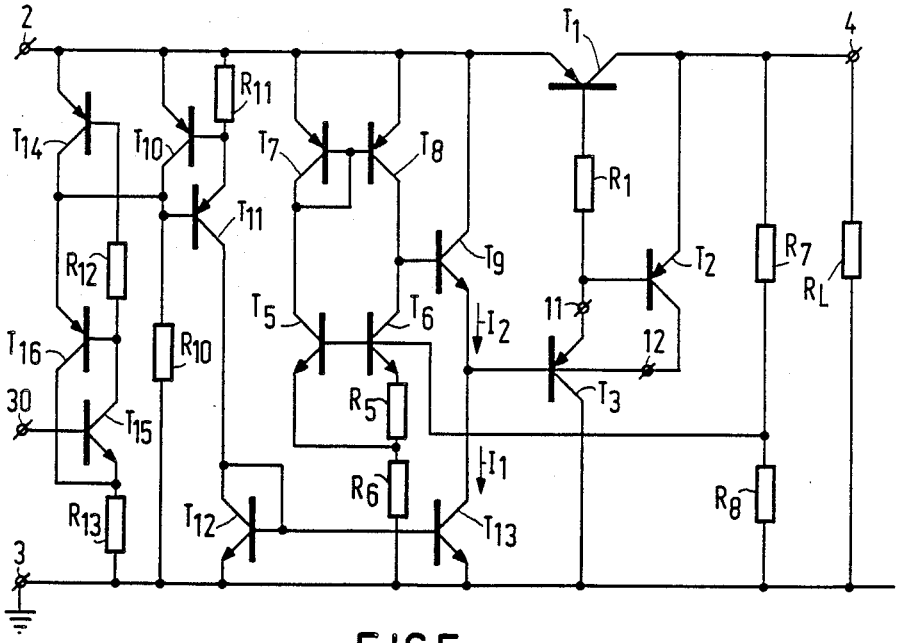

Embodiments of the invention will now be described in more detail, by way of example, with reference to the accompanying drawings, in which FIG. 1 illustrates the principle of a circuit arrangement in accordance with the invention, FIG. 2 shows a first embodiment of the invention, FIG. 3 shows a second embodiment of the invention, FIG. 4 shows the circuit arrangement of FIG. 2 used in a voltage regulator, and FIG. 5 shows the circuit arrangement of FIG. 3 used in the voltage regulator of FIG. 4.

FIG. 1 shows the basic diagram of a circuit arrangement in accordance with the invention. The circuit arrangement comprises a first PNP transistor $T_1$ whose emitter is connected to a first power-supply terminal 2 and whose collector is connected to an output terminal 4, connected in turn to a load $R_L$, shown schematically. A first resistor $R_1$ connects the base of the transistor $T_1$ to the output 11 of a drive circuit 10, which provides the drive for the transistor $T_1$. The drive circuit 10 is coupled to the second power-supply terminal 3, which in the present case is connected to ground. The circuit arrangement further comprises a second PNP transistor $T_2$ whose emitter is connected to the collector of the transistor $T_1$, whose base is connected to that end of the resistor $R_1$ which is situated nearest the drive circuit 10, and whose collector is connected to a control input 12 of the drive circuit 10. The resistor $R_1$ and the transistor $T_2$ constitute the limiting circuit by means of which the collector-emitter voltage of the transistor $T_1$ is limited.

The power-supply terminals 2 and 3 are connected to, for example, a battery. The drive circuit 10 controls the collector-emitter voltage of the transistor $T_1$ by driving its base so as to maintain the voltage on the output terminal 4 substantially constant. As the battery is discharged the battery voltage approximates to the stabilised output voltage at a given instant. The transistor $T_1$ is then bottomed. In the case of strong saturation the substrate diode is turned on, which gives rise to large substrate currents. This causes the battery to be discharged very rapidly, which unnecessarily shortens the battery life. This is precluded by means of the limiting circuit in accordance with the invention. The base current of the transistor $T_1$ is converted into a voltage by a resistor $R_1$. The difference between the emitter-collector voltage of transistor $T_1$ and the sum of the voltages across resistor $R_1$ and the base-emitter voltage of the transistor $T_1$ appears across the base-emitter junction of the transistor $T_2$. When the transistor $T_1$ is saturated the base current of the transistor $T_1$ increases as a result of the decreasing current gain, causing the voltage across the resistor $R_1$ to increase, while the emitter-collector voltage of the transistor $T_1$ decreases in the case of saturation. When a specific degree of saturation is reached the transistor $T_2$ is consequently turned on. By means of the collector current of the transistor $T_2$, the drive circuit 10 then reduces the drive applied to the base of the transistor $T_1$, causing the collector-emitter voltage of this transistor to increase. In this way the transistor $T_1$ cannot be driven into strong saturation, thereby precluding the occurrence of substrate currents. The emitter-collector voltage can be limited to, for example, 200 mV by a suitable choice of the resistance value of the resistor $R_1$.

FIG. 2 shows a first embodiment of the invention. Identical parts bear the same reference numerals as in FIG. 1. In this embodiment the drive circuit 10 comprises a PNP transistor $T_3$, whose emitter is connected to the output 11 and whose collector is connected to the second power-supply terminal 3. The base of the transistor $T_3$ is connected to a current source 13, which supplies the drive current for this transistor, and to the control input 12, to which the collector of the transistor $T_2$ is connected. Since the transistor $T_2$ is turned on below a specific collector-emitter voltage of the transistor $T_1$, the transistor $T_2$ supplies a part of the current of the current source 13, causing the base current of the transistor $T_3$ to decrease. Consequently, the base current of the transistor $T_1$ also decreases, causing the collector-emitter voltage of this transistor to increase.

FIG. 3 shows a second embodiment of the invention, identical parts again bearing the same reference numerals as in FIG. 1. The drive circuit 10 in this embodiment comprises an NPN transistor $T_4$, whose collector is connected to the output 11 and whose emitter is connected to the second power-supply terminal 3 via a resistor $R_2$. The base of the transistor $T_4$ is connected to a voltage source 14, which supplies the drive voltage for this transistor. In this case the control input is connected to the emitter of the transistor $T_4$. When the transistor $T_2$ is turned on below a specific collector-emitter voltage of the transistor $T_1$ the voltage across the resistor $R_2$ increases, so that the base-emitter voltage of the transistor $T_4$ decreases. The base current of the transistor $T_1$ consequently decreases, which causes the collector-emitter voltage of the transistor $T_1$ to increase.

FIG. 4 shows a practical example of the circuit arrangement shown in FIG. 2, identical parts again bearing the same reference numerals. The current source 13 for driving the transistor $T_3$ in FIG. 2 now comprises a current source 15 supplying a constant current $I_1$ and a detection circuit 20 supplying a current $I_2$ which is proportional to the difference between the output voltage across the terminals 3 and 4 and a reference voltage. The difference between the currents $I_1$ and $I_2$ form the base current of the transistor $T_3$.

The detection circuit 20 comprises a voltag-estabilising circuit known per se, comprising two transistors $T_5$ and $T_6$ whose emitter-area ratio is equal to n. The series arrangement of the base-emitter junction of the transistor $T_6$ and a resistor $R_5$ is connected in parallel with the base-emitter junction of the transistor $T_5$. Further, a resistor $R_6$ is connected in series with the resistor $R_5$. The commoned bases of the transistors $T_5$, $T_6$ are connected to the tapping of a voltage divider comprising the resistors $R_7$ and $R_8$, which divider is arranged between the output terminal 4 and the power-supply terminal 3. The collector of the transistor $T_5$ is connected to the collector of the transistor $T_6$ by means of a current mirror comprising a diode-connected transistor $T_7$ and a transistor $T_8$. The collector of said transistor $T_6$ is further connected to the base of a transistor $T_9$, whose collector is connected to the input terminal 2 and whose emitter is connected to the base of the transistor $T_3$. The current mirror $T_7$, $T_8$ ensures that only equal currents can flow through the transistors $T_5$ and $T_6$. These currents through the transistors $T_5$ and $T_6$ can only be equal to $$(U_T/R_5) \ln n,$$

where $U_T$ is the thermal voltage. In that case the voltage on the base of the transistors $T_5$, $T_6$ has a reference value determined by this current. The voltage on the commoned bases of the transistors $T_5$, $T_6$ is equal to the voltage at the tapping of the voltage divider $R_7$, $R_8$. By means of the transistor $T_3$ the transistor $T_1$ is now driven in such a way that the voltage at this tapping is equal to said reference voltage. When the voltage at the output terminal 4 is now assumed to increase, this means that the voltage divider $R_7$, $R_8$ and hence the voltage on the commoned bases of the transistors $T_5$, $T_6$ increases. As a result of the presence of the resistor $R_5$ the current through the transistor $T_5$ increases to a greater extent than that through the transistor $T_6$. This causes the base current of the transistor $T_9$ to increase so that the current $I_2$ increases. Consequently, the base current of the transistor $T_3$ and hence the base current of the transistor $T_1$ decrease. As a result of this, the collector-emitter voltage of the transistor $T_1$ increases so that the voltage on the output terminal 4 decreases. In this way the voltage on the output terminal is maintained constant.

FIG. 5 shows another example of the circuit shown in FIG. 4, employing the arrangement shown in FIG. 3. Identical parts bear the same reference numerals as in FIG. 4. In the present example the current source 15 of FIG. 4 comprises the series arrangement of the collector-emitter path of a transistor $T_{10}$ and a resistor $R_{10}$, which is arranged between the power-supply terminals 2 and 3. The base of the transistor $T_{10}$ is connected to the power-supply terminal 2 via a resistor $R_{11}$ and is connected to its collector via the base-emitter junction of transistor $T_{11}$. The collector of the transistor $T_{11}$ is connected to the base of the transistor $T_3$ by means of a current mirror comprising a diode-connected transistor $T_{12}$ and a transistor $T_{13}$. This current source and consequently the entire circuit arrangement can be rendered inoperative when a circuit arrangement as shown in FIG. 3 is added. For this purpose the circuit arrangement comprises a transistor $T_{14}$ whose collector-emitter path is arranged in parallel with that of the transistor $T_{10}$. The base of the transistor $T_{14}$ is connected to the collector of a driver transistor $T_{15}$ via a resistor $R_{12}$, which driver transistor has its emitter connected to the power-supply terminal 3 by a resistor $R_{13}$. The base of the transistor $T_{15}$ is connected to a switching input 30, to which a switching voltage can be applied. The base-emitter junction of a transistor $T_{16}$ is arranged between the collector of the transistor $T_{15}$ and the collector of the transistor $T_{14}$ and the collector of the said transistor $T_{16}$ is connected to the emitter of the transistor $T_{15}$. In the absence of a voltage on the switching input 30 the transistor $T_{15}$ does not conduct and the transistor $T_{14}$ does not influence the operation of the remainder of the arrangement. By applying a voltage of, for example, 1.6V to the switching input 30 the transistor $T_{15}$ and hence the transistor $T_{14}$ are turned on. The collector current of the transistor $T_{14}$ flows through the resistor $R_{10}$, causing the voltage on the collector of the transistor $T_{10}$ to increase. In the case of saturation of the transistor $T_{10}$ the current source is switched off because the voltage on the collector of the transistor $T_{10}$ should be equal to at least two base-emitter voltages. At the same time the transistor $T_{14}$ is also bottomed. In order to prevent the occurrence of large substrate currents the collector-emitter voltage of the transistor $T_{14}$ is limited to a specific minimum value by means of the transistor $T_{16}$ and the resistor $R_{12}$, as is described with reference to FIG. 3. The circuit arrangement shown in FIG. 5 may be employed in, for example, a radio receiver where such an arrangement may be used for powering the FM section and another such arrangement may be used for powering the AM section of the receiver. When changing over from FM to AM and vice versa, the switching voltage is then transferred from the switching input of one arrangement to the switching input of the other arrangement.

The invention is not limited to the embodiments described herein. Within the scope of the invention many variants are conceivable to those skilled in the art. For example, the transistor $T_1$ may be constructed as a plurality of parallel-connected transistors or as a Darlington transistor. The drive circuit 10 in FIG. 1 may also be constructed in another way than shown in FIGS. 2 and 3. The construction of the detection circuit 20 in FIG. 4 is irrelevant to the invention. In the embodiment shown in FIG. 5 a resistor may be arranged in parallel with the base-emitter junction of the transistor $T_{14}$ in order to ensure that this transistor is turned on rapidly. Further, in this embodiment the base-emitter junction of a further transistor may be arranged in parallel with the base-emitter junction of the transistor $T_{11}$, the collector of the further transistor being connected to the emitter of the transistor $T_{15}$. The further transistor ensures that the transistor $T_{15}$ is not conductive when the arrangement is operative.

What is claimed is:

1. A circuit arrangement comprising:

a first transistor of a first conductivity type having an emitter coupled to a first power-supply terminal, a collector coupled to an output terminal, and a base, a drive circuit for driving the first transistor, said drive circuit being coupled to a second power supply terminal and having an output coupled to the base of the first transistor, and a limiting circuit for limiting the voltage between the emitter and the collector of the first transistor to a specific value by reducing the drive to the first transistor when said voltage decreases below said specific value, wherein the limiting circuit comprises a first resistor connected between the output of the drive circuit and the base of the first transistor, and a second transistor of the first conductivity type having an emitter coupled to the collector of the first transistor, a collector coupled to a control input of the drive circuit, and a base coupled to that end of the first resistor which is situated nearest the drive circuit output.

2. A circuit arrangement as claimed in claim 1, wherein the drive circuit comprises a third transistor of a second conductivity type having an emitter coupled to the second power-supply terminal by means of a second resistor, a collector coupled to the output of the drive circuit, and a base coupled to a circuit for supplying a control voltage to the third transistor, and wherein the control input of the drive circuit comprises the emitter of the third transistor.

3. A circuit arrangement as claimed in claim 1, wherein the drive circuit comprises a third transistor of the first conductivity type having an emitter coupled to the output of the drive circuit, a collector coupled to the second power-supply terminal, and a base coupled to a circuit for supplying a control current to the third transistor, and wherein the control input of the drive circuit comprises the base of the third transistor.

4. A circuit arrangement as claimed in claim 3, wherein the circuit for supplying a control current to the third transistor comprises a constant-current source for supplying a first current and a detection circuit for supplying a second current proportional to the difference in the voltage between the output terminal and the second power-supply terminal and a reference voltage, wherein the control current is determined by the difference between the first current and the second current.

5. A circuit arrangement as claimed in claim 4, wherein the constant-current source comprises a fourth transistor of the first conductivity type having an emitter connected to the first power-supply terminal, a collector connected to the second power-supply terminal via a second resistor, and a base coupled to its collector, and the circuit arrangement further comprises a fifth transistor of the first conductivity type having an emitter coupled to the emitter of the fourth transistor, a collector connected to the collector of the fourth transistor, and a base, and a sixth transistor of the second conductivity type having a collector connected to the base of the fifth transistor via a third resistor, an emitter connected to the second power-supply terminal via a fourth resistor, and a base connected to a switching input for applying a switching voltage, and a seventh transistor of the first condctivity type having an emitter connected to the collector of the fifth transistor, a collector connected to the emitter of the sixth transistor, and a base connected to that end of the third resistor which is connected to the collector of the sixth transistor.

6. A transistor circuit comprising:

an input terminal for connection to a source of voltage, an output terminal for connection to a load, a first transistor connected in series between said input and output terminals for controlling current to a load, a drive circuit having an output coupled to a control electrode of the first transistor via a resistor thereby to control the drive of said first transistor, and a voltage limiting circuit controlled by the emitter-collector voltage of the first transistor for limiting said emitter-collector voltage to a given value by limiting the drive to the first transistor when said emitter-collector voltage drops below said given value, said voltage limiting circuit including said resistor and a second transistor of the same conductivity type as the first transistor with the second transistor connected between an output electrode of the first transistor and a control input of the drive circuit, and means coupling a control electrode of the second transistor to the resistor in a manner such that the second transistor is responsive to the emitter-collector voltage of the first transistor to signal the drive circuit to limit the drive to the first transistor when the emitter-collector voltage of the first transistor drops below said given value.

7. A transistor circuit as claimed in claim 6 wherein the drive circuit comprises a third transistor of opposite conductivity type to that of the first transistor and connected in series with a second resistor between the output of the drive circuit and a second input terminal for the source of voltage, means coupling a control electrode of the third transistor to a source of control voltage, and wherein said control input of the drive circuit is coupled to said second resistor.

8. A transistor circuit as claimed in claim 6 wherein the drive circuit comprises a third transistor of the same conductivity type as the first transistor and connected between the output of the drive circuit and a second input terminal for the source of voltage, means coupling a control electrode of the third transistor to a soure of control current, and wherein said control input of the drive circuit is coupled to said control electrode of the third transistor.

9. A transistor circuit as claimed in claim 8 wherein the control current source comprises, a constant current source coupled to the control electrode of the third transistor and supplying a first current, a detection circuit coupled to the control electrode of the third transistor for supplying a second current proportional to the difference in the voltage at the output terminal and a reference voltage whereby the control current is proportional to the difference of said first and second currents.

10. A transistor circuit as claimed in claim 9 wherein said reference voltage is derived from a voltage divider coupled to said output terminal.

11. A transistor circuit as claimed in claim 6 wherein the value of the resistor is chosen so that the second transistor is normally in cut-off when said emitter-collector voltage of the first transistor is above said given value.

12. A transistor circuit as claimed in claim 6 wherein the transistor circuit is part of an integrated circuit having a substrate and wherein said given value of the emitter-collector voltage of the first transistor is determined by a circuit operating point at which large substrate currents begin to flow.

13. A transistor circuit as claimed in claim 6 wherein the second transistor is normally in cut-off when said emitter-collector voltage of the first transistor is above said given value, said second transistor commencing conduction when the difference between the emitter-collector voltage of the first transistor and the sum of the voltages across the resistor and the base-emitter of the first transistor exceeds the base-emitter threshold voltage of the second transistor.

14. A transistor circuit as claimed in claim 6 wherein the input terminal is intended for connection to a source of unregulated d.c. voltage so that the transistor circuit will operate as a voltage regulator, the voltage regulator further comprising means coupled to the output terminal for deriving a reference voltage determined by the output voltage, and means coupling said reference voltage to the drive circuit so as to control the drive of the first transistor in a sense to maintain the voltage at the output terminal relatively constant.

* * * * *